US005242272A

United States Patent [19]

Ven et al.

[11] Patent Number: 5,242,272

[45] Date of Patent: Sep. 7, 1993

[54] METHOD AND DEVICE FOR PUMPING A LIQUID AT HIGH TEMPERATURE THROUGH A PIPE

[76] Inventors: Kari Ven, Lange Leemstraat 423; Juha Ven; Timo Ven, both of Desguinlei 206, all of 2018 Antwerpen; Petri Ven; Irja Ven, both of Sint-Hubertusstraat 89, both of 2600 Antwerp, all of Belgium

[21] Appl. No.: 829,065

[22] PCT Filed: Jul. 31, 1990

[86] PCT No.: PCT/BE90/00044

§ 371 Date: Feb. 10, 1992

§ 102(e) Date: Feb. 10, 1992

[87] PCT Pub. No.: WO91/02166

PCT Pub. Date: Feb. 21, 1991

[30] Foreign Application Priority Data

Aug. 10, 1989 [BE] Belgium ..... 08900861

[51] Int. Cl.[5] ..... F04F 1/10; F04F 1/14; F15B 21/04

[52] U.S. Cl. ..... 417/122; 91/4 R; 60/478

[58] Field of Search ..... 417/139, 122, 123, 124, 417/125; 91/4, 4 R; 60/403, 478

[56] References Cited

U.S. PATENT DOCUMENTS

| | | | |
|---|---|---|---|
| 3,005,417 | 10/1961 | Swaney | 417/125 |
| 3,901,033 | 8/1975 | McAlister | 91/4 R |
| 4,086,765 | 5/1978 | Gillilan | 417/125 |

FOREIGN PATENT DOCUMENTS

| | | | |
|---|---|---|---|
| 3012505 | 10/1980 | Fed. Rep. of Germany | 417/122 |
| 1557569 | 2/1969 | France . | |
| 1428840 | 10/1988 | U.S.S.R. | 417/125 |
| 1148580 | 4/1969 | United Kingdom . | |
| 2204363 | 11/1988 | United Kingdom | 417/125 |
| 8101246 | 5/1981 | World Int. Prop. O. . | |

OTHER PUBLICATIONS

Patent Abstracts of Japan, vol. 6, No. 232 (M-172) (1110), Nov. 18, 1982, & JP, A, 57131900 (Kosumo Automation K.K.) Aug. 14, 1982.

*Primary Examiner*—Richard A. Bertsch
*Assistant Examiner*—Roland McAndrews
*Attorney, Agent, or Firm*—Oblon, Spivak, McClelland, Maier & Neustadt

[57] ABSTRACT

Procedure for pumping liquid at high temperature through a pipe, characterized in that the liquid at high temperature is pressed, by means of a fluid at low temperature that is inert in relation to the liquid at high temperature, away out of a first reservoir that is mounted on an extremity of the pipe. The liquid at high temperature which is pressed out is taken up in a second reservoir that is mounted on the other extremity of the pipe, while the aforementioned fluid that is in the second reservoir, is let out, after a time the liquid at high temperature is now pressed out of this second reservoir and is taken up again in the first reservoir, and this by means of the aforementioned fluid that is now let out of the first reservoir and is pumped into the second reservoir. The pumping procedure including means to calculate a flow rate through the pipe via temperature and level indicators, taking into account expansion or contraction of the high temperature liquid.

14 Claims, 1 Drawing Sheet

METHOD AND DEVICE FOR PUMPING A LIQUID AT HIGH TEMPERATURE THROUGH A PIPE

BACKGROUND OF THE INVENTION

The invention relates to a method for pumping a liquid at high temperature, this is a temperature above 98 degrees Centigrade through a pipe, according to which the liquid at high temperature is pressed by means of a fluid at a temperature lower than the high temperature away out of a first reservoir that is mounted on an extremity of the pipe, the liquid at high temperature which is pumped away is taken up in a second reservoir that is mounted on the other extremity of the pipe, while the aforementioned fluid that is in the second reservoir is let out, and after a time the liquid at high temperature is now pressed out of this second reservoir and is taken up again in the first reservoir, and this by means of the aforementioned fluid that is now let out of the first reservoir and is pumped into the second reservoir.

Fluid that is inert in relation to the liquid at high temperature is a fluid, gaseous or liquid, that does not mix or react with the liquid at high temperature.

The liquid at high temperature does not come into contact with moving pump parts but only with the inert fluid at lower temperature, for pumping for which pumps on the market can be used without problems.

DISCUSSION OF THE RELATED ART

A method of this kind is known from FR-A-1 557 569. This document describes pumping liquid sodium using an inert oil. Although the two reservoirs are each provided with level detectors, only predetermined limit levels are detected to determine the moment the flow direction of the liquid through the pipe from one reservoir to the other has to be inverted.

SUMMARY OF THE INVENTION

A first object of the invention is to provide a method according to which a possible clogging of the pipe will be immediately detected.

For this purpose, the level of the liquid at high temperature in a reservoir and the temperature of the liquid during pumping are measured at least from time to time, the expansion or shrinking of the liquid due to changes in temperature is calculated and the flow rate is calculated on the basis of changes of level and taking into account the calculated expansion or shrinking.

The flow measurement permits immediate detection of clogging.

Another object of the invention is to provide a method according to which possible leaks in the pipe can be detected. Leaks, especially of sodium, may be very dangerous.

For this purpose, the level of the liquid at high temperature in both reservoirs and the temperature of the liquid during pumping are measured at least from time to time, the total liquid volume contained in the device is calculated on the basis of the levels measured and this volume is compared with a total volume calculated from a preceding level measurement, possibly taking into account a change in volume due to a temperature change of the liquid if such change did occur between the two measurements.

This invention also relates to a device which is especially suitable for utilizing the method according to one of the aforementioned embodiments.

The invention thus relates to a device for pumping liquid at high temperature, this is a temperature above 98 degrees Centigrade through a pipe, the device comprising two reservoirs which are mounted on both extremities of the pipe, two supply pipes for supplying respectively to each of the reservoirs a fluid at a temperature lower than the high temperature that is inert in relation to the liquid at high temperature, means to close the supply pipes separately so that when one is closed the other can be open, at least one pump to pump fluid at low temperature via the supply pipes into one reservoir respectively the other reservoir, two outlet pipes to let the inert fluid out of one respectively the other reservoir, means to close these outlet pipes separately in such a manner that when one is closed the other can however be open, and a level indicator mounted in the two reservoirs for measuring the level of the liquid at high temperature.

In a first embodiment, the device is characterised in that it comprises means to measure the temperature of the liquid at high temperature and means to calculate on the basis of this temperature, the expansion or shrinking of the liquid and to calculate from the change of level measured by the level indicator in a reservoir and taking into account the aforementioned expansion or shrinking, the flow rate.

In a second embodiment the device is characterised in that it comprises means to measure the temperature of the liquid at high temperature and means to calculate, on the basis of the levels measured by the level indicators in the two reservoirs at the measured temperature the total liquid volume contained in the device, and to compare this total volume with the total volume calculated from a preceding level measurement, possibly taking into account a change in volume due to a temperature change if such change did occur between the two measurements.

BRIEF DESCRIPTION OF THE DRAWINGS

Other details and advantages will appear from the following description of a method and a device for pumping liquid at high temperature through a pipe. This description is only given as an example and does not restrict the invention. The reference numbers concern the annexed drawings in which.

DESCRIPTION OF THE PREFERRED EMBODIMENTS

Figure 1:
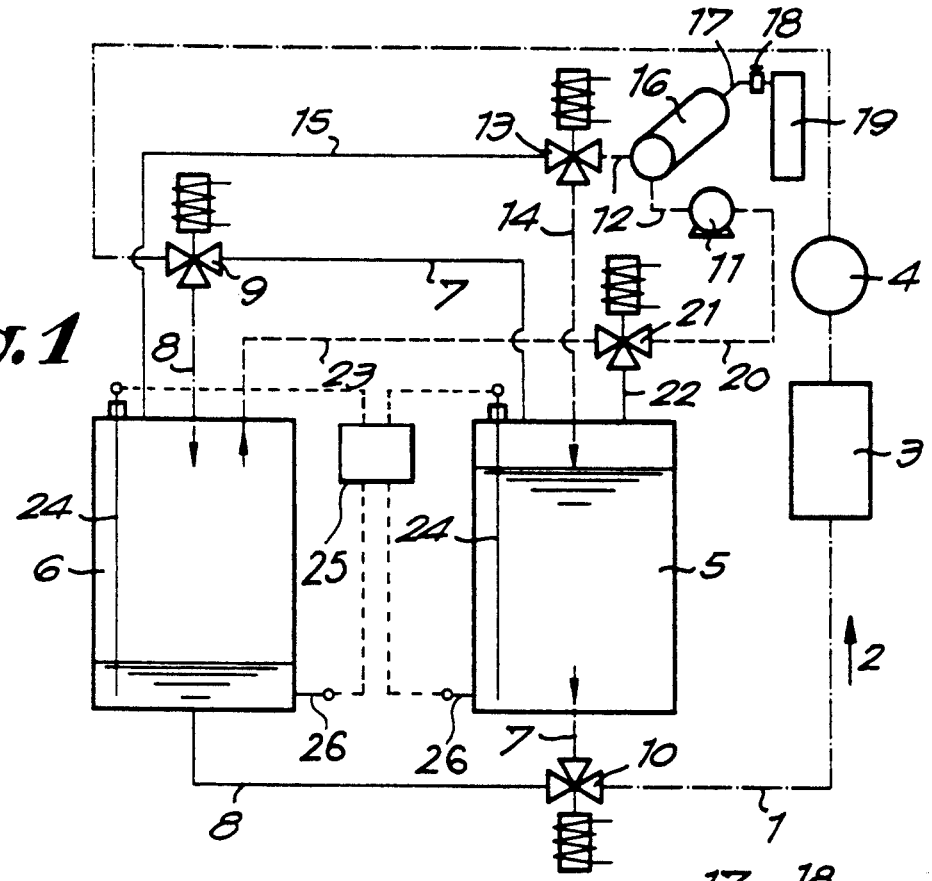
FIG. 1 is a schematic representation of a heat exchanging circuit in which a device is mounted for pumping liquid at high temperature according to the invention.

In the two figures the same reference numbers relate to the same elements.

The heat exchanging circuit that is represented in the figures contains in a known manner a pipe 1 for liquid sodium at a temperature between 450 and 800 degrees Centigrade, which extends in a closed circuit. In this pipe 1 a heat exchanger 3 and a heat motor 4 are mounted in a known manner facing each other in the direction of flow of the liquid sodium indicated by arrow 2 in the figures. The heat exchanger 3 serves for supplying heat to the liquid sodium and is for example a solar battery. The motor 4 serves to make use of heat from the liquid sodium and to convert it into kinetic energy. A suitable heat motor is for example the so-called "Sterling"-motor.

The pumping around of the liquid sodium through the pipe 1 is effected by means of a device for pumping.

According to the invention this device for pumping contains two reservoirs 5 and 6 which are mounted in parallel with each other in the pipe 1 and in particular respectively in two channels 7 and 8 of the part of the pipe 1 that is split into two parallel channels.

At the location of the junction of the two channels 7 and 8 and the rest of the pipe 1, upstream from the reservoirs 5 and 6, a three-way cock 9 is mounted. Downstream a three-way cock 10 is mounted on the junction of the channels 7 and 8 and the rest of the pipe 1. The two three-way cocks 9 and 10 are electric cocks which can be operated by remote control.

The sodium is pushed via the pipe 1 from one reservoir 5 to the other reservoir 6 or vice versa by means of a gas that is inert in relation to the liquid sodium and therefore neither mixes nor reacts with it. A suitable gas for example is nitrogen. This inert gas exists at low temperature (lower than 100 degrees Centigrade).

The device for pumping for this purpose contains a pump 11 on the outlet to which the pipe part 12 connects. At the location of a three-way cock 13, which can be operated by remote control, this pipe part 12 subdivides into a first branch 14 which flows out at the top into the reservoir 5 and a second branch 15 which flows out at the top into the reservoir 6. In the pipe part 12 a small reservoir 16 is still mounted for the inert gas. This reservoir 16 is connected to a cylinder 19 with inert gas under pressure via a pipe 17 in which a stopcock is mounted.

To the inlet of the pump 11 a pipe part 20 connects that is subdivided at the location of a second electric three-way cock 21, which can be operated by remote control, into a first branch 22 which connects to the top of the reservoir 5 and a second branch 23 which connects to the top of the reservoir 6. The branches 22 and 23 together with the pipe part 20 form outlet pipes for discharging the inert gas out of the reservoirs 5 and 6, while the aforementioned branches 14 and 15 together with the common pipe part 12 form supply pipes for supplying inert gas to these reservoirs 5 and 6.

The pumping around of the liquid sodium occurs in the two phases which continually follow each other.

Figure 2:
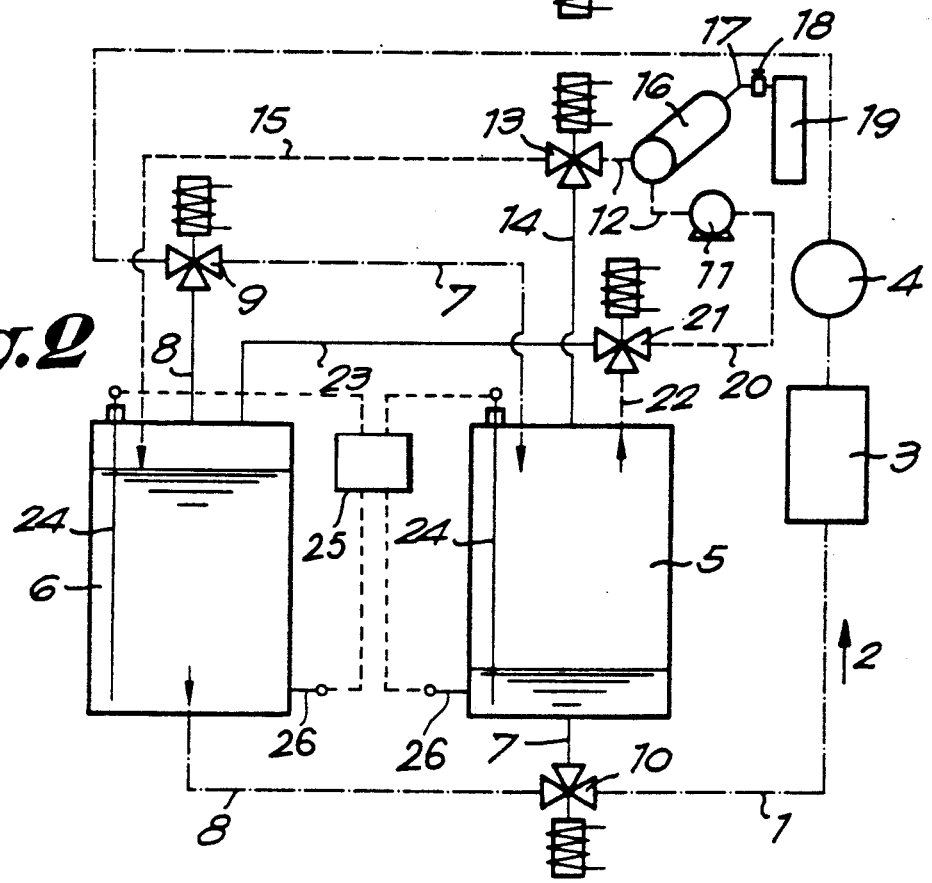
FIG. 2 is a schematic representation of the circuit with a device for pumping from FIG. 1 but relating to another phase of the pumping.

FIG. 1 relates to the first phase and FIG. 2 to the second. In both figures the flow of the liquid sodium 2 is represented in dotted-dashed line while the flow of the inert gas is represented in regular dashed line.

As appears from FIG. 1 in the first phase the three-way valve 13 is in the position whereby the common pipe part 12 is connected to the branch 14 but the branch 15 is closed while the three-way cock 21 is in the position whereby the pipe part 20 is connected to the branch 23 but the branch 22 is closed. The pump 11 therefore sucks inert gas via the pipe part 20, the three-way cock 21 and the branch 23 out of the reservoir 6, into which, as will further be described, liquid sodium is supplied. The pump 11 presses inert gas via the pipe part 12 and the reservoir 16, the three-way cock 13 and the branch 14 into the reservoir 5. This inert gas presses the liquid sodium away out of the reservoir 5.

The three-way cock 10 is in the position whereby downstream from the reservoirs the channel 7 is connected to the rest of the pipe 1, but the channel 8 is closed, while the three-way cock 9 upstream from the reservoirs is in the position whereby the channel is connected to this rest of the pipe but the channel 7 is closed. The liquid sodium pressed away out of the reservoir 5 therefore flows via a part of the channel 7, the three-way cock 10, the rest of the pipe 1, the three-way cock 9 and the part of the channel 8 and is again taken up in the reservoir 6. When the reservoir 6 is nearly full, and as a result the reservoir 5 almost empty, the position of all the three-way cocks 9, 10, 13 and 21 change to the position presented in FIG. 2.

The three-way cock 13 now connects the pipe part 12 to the branch 15 but closes the branch 14 while the three-way cock 21 connects the pipe part 20 to the branch 22 but closes the branch 23. The inert gas is now pumped out of the reservoir 5 and pressed into the reservoir 6 by the pump 11.

The three-way cock 9 is in the position whereby upstream from the reservoirs the channel 8 is closed and the channel 7 is connected to the rest of the pipe 1 while the three-way cock 10 is in the position whereby downstream the channel 8 is connected to the rest of the pipe 1 and the channel 7 is closed. Liquid sodium is as a result pressed away out of the reservoir 6 by the inert gas, flows through the pipe 1 and is again taken up in the reservoir 5.

After the reservoir 5 is almost full and the reservoir 6 almost empty all the three-way cocks 9, 10, 13 and 21 are brought back to the aforementioned initial position represented in FIG. 1 whereby the aforementioned first phase recurs and so forth whereby each time a first and a second phase follow each other.

The sodium at high temperature is pumped around safely and without problems. The sodium nowhere comes into contact with turning parts of a pump. The flow rate of the sodium can very easily be changed by altering the pressure of the inert gas. In each of the reservoirs 5 and 6 a level indicator 24 is also mounted, for example of the float type. Because the section of reservoirs 5 and 6 is constant, the change of level will be proportional to the flow rate, so that the flow rate can be calculated, for instance by a computer 25 from consecutive readings of level. Hereby, the expansion or the shrinking corresponding to temperature increase respectively decrease of the liquid sodium, has to be taken into account. The magnitude of this expansion or shrinking can be calculated from the temperature, that is measured by thermometer 26.

It is essential that the volume of both reservoirs 5 and 6 has been selected to be able to contain in each reservoir all the sodium at its highest expansion, corresponding with maximum heating of the sodium. This expansion is completely free, as the return flow of the sodium pumped from one of the reservoirs 5 or 6 to the other is completely free. A possible clogging of the pipe, disabling the flow, will be immediately detected by the aforementioned flow measurement.

By comparing an instant level measurement with a preceding measurement, the result of which has been delayed or temporary kept in a memory, possible leaks in the device can be detected. The temperature being known, the complete volume of the sodium at that temperature at that time can be calculated for instance with a computer. A decrease of this total volume relative to the one calculated from a precedent measurement, while temperature condition has not been changed, means some sodium has been lost and consequently a leak is present. Also when temperature has changed in the meanwhile, these volumes can be calculated, but then the computer 25 has to take into account the change in volume caused by the temperature difference.

An additional feature offered by the pumping device described herebefore, is to collect all the liquid sodium in the reservoirs 5 and 6, instead of pumping it around, by appropriately positioning the three way valve. This may be useful when the complete heat exchange circuit is taken out of operation, for instance because no heat can be added by means of the heat exchanger 3 to pipe 1. The temperature of the sodium will drop until the latter solidifies. The sodium will only solidify in the reservoirs 5 and 6 and in order to start up again the complete device, heating the two reservoirs 5 and 6 will be sufficient.

The invention is in no way restricted to the embodiment described above, and within the scope of the patent application many changes can be applied to the described embodiment, among others regarding the form, the construction, the arrangement and the number of the parts which are used implementing the invention.

In particular the liquid at high temperature need not necessarily be sodium.

Also the liquid at low temperature that is used for pumping need not necessarily be nitrogen and even not necessarily an inert gas. It could also be an inert liquid insofar that this does neither react nor mix with the liquid at high temperature.

Further it is not absolutely necessary that a heat exchanger and a motor are mounted in the pipe. The liquid at high temperature could be used for other purposes than the driving of a motor.

The liquid to be pumped need not necessarily be liquefied metal such as liquefied sodium. Other liquids, including slurries may be used.

We claim:

1. A method for pumping liquid at a high temperature above 98 degrees Centigrade through a pipe, comprising the steps of:

pressing the liquid at high temperature by means of a fluid having a temperature lower than the high temperature that is inert in relation to the liquid at high temperature, out of a first reservoir that is mounted on an extremity of the pipe;

taking up the liquid at high temperature which is pressed out of the first reservoir into a second reservoir that is mounted on another extremity of the pipe, while evacuating said lower temperature fluid from the second reservoir;

pressing out the liquid at high temperature from the second reservoir so as to be received in the first reservoir by means of said lower temperature fluid evacuated from the first reservoir and pumped into the second reservoir;

intermittently measuring a level of the liquid at high temperature in one of the first and second reservoirs and the temperature of the liquid during pumping;

calculating an expansion or shrinkage of the high temperature liquid due to changes in temperature; and calculating a flow rate based on changes of liquid level and taking into the account the calculated expansion or shrinkage.

2. A method for pumping liquid at a high temperature above 98 degrees Centigrade through a pipe, comprising the steps of:

pressing the liquid at high temperature by means of a fluid at a temperature lower than the high temperature that is inert in relation to the liquid at high temperature, out of a first reservoir that is mounted on an extremity of the pipe;

taking up the liquid at high temperature which is pressed out of the first reservoir into a second reservoir that is mounted on another extremity of the pipe, while evacuating said lower temperature fluid in the second reservoir;

pressing out the liquid at a high temperature from the second reservoir so as to be received in the first reservoir by means of said lower temperature fluid evacuated from the first reservoir and pumped into the second reservoir;

intermittently measuring a level of the liquid at high temperature in the first and second reservoirs and a temperature of the liquid during pumping;

calculating a total liquid volume in the device based on the measured levels; and comparing the volume with a total volume calculated from a preceding level measurement taking into account a change in volume due to a temperature change of the liquid.

3. Method according to claim 1 or 2, wherein the liquid at high temperature is pumped through a pipe which forms a closed circuit, whereby, the first and second reservoirs are mounted in parallel with each other in the closed circuit.

4. Method according to claim 1 or 2 wherein, the fluid at low temperature that is evacuated from one of said first and second reservoirs is returned to the other of said first and second reservoirs by means of a pump and this fluid is therefore successively pumped from said one reservoir to said other reservoir and vice versa.

5. Method according to claim 1 or 2 wherein, insert gas is used as fluid at low temperature.

6. Method according to claim 1 or 2 wherein, liquid sodium is used as liquid at high temperature.

7. A device for pumping liquid at a high temperature above 98 degrees Centigrade through a pipe, the device comprising:

first and second reservoirs which are mounted on first and second extremities of the pipe;

first and second supply pipes for supplying respectively to each of the reservoirs a fluid at a temperature lower than the high temperature that is inert in relation to the liquid at high temperature;

means for closing the supply pipes separately so;

at least one pump said to pump fluid at low temperature via the supply pipes onto one of said first and second reservoirs or the other of said first and second reservoirs;

first and second outlet pipes for letting said lower temperature inert fluid out of one of said first and second reservoirs or the other of said first and second reservoirs;

means for closing the outlet pipes separately in such a manner;

a level indicator mounted in the first and second reservoirs for measuring a level of the liquid at high temperature;

means for measuring the temperature of the liquid at high temperature; and means for calculating on the basis of the temperature, an expansion or shrinkage of the high temperature liquid and calculating a flow rate from the change of level measured by the level indicator in a reservoir taking into account the expansion or shrinkage.

8. A device for pumping liquid at a high temperature above 98 degrees Centigrade through a pipe, the device comprising:

first and second reservoirs which are mounted on first and second extremities of the pipe;

first and second supply pipes for supplying respectively to each of the reservoirs a fluid at a temperature lower than the high temperature that is inert in relation to the liquid at high temperature;

means for closing the supply pipes separately;

at least one pump said to pump fluid at low temperature via the supply pipes into one of said first and second reservoirs or the other of said first and second reservoirs;

first and second outlet pipes to let said lower temperature inert fluid out of one of said first and second reservoirs or the other of said first and second reservoirs;

means for closing the outlet pipes separately in such a manner;

a level indicator mounted in the first and second reservoirs for measuring a level of the liquid at high temperature;

means for measuring the temperature of the liquid at high temperature; and means for calculating, on the basis of the levels measured by the level indicators in the first and second reservoirs at the measured temperature, a total liquid volume contained in the device, and comparing the total volume with the total volume calculated from a preceding level measurement, taking into account a change in volume, due to a temperature change between the two measurements.

9. Device according to claim 7 or 8, wherein the content of the first and second reservoirs is so calculated that they can receive a expansion of the liquid at high temperature caused by temperature rises, and that the return flow of the liquid pumped from the one reservoir to the other, is unhindered.

10. Device according to claim 7 or 8 wherein, the first and second supply pipes said fluid at low temperature connect to the outlet of a pump, and the first and second outlet pipes for the fluid at low temperature connect to the inlet of said pump.

11. Device according to claim 7 or 8 wherein, the first and second supply pipes connect via a three-way cock and a common pipe part to the outlet of a pump while the first and second outlet pipes connect via a further three-way cock and a further common pipe part to the inlet of said pump.

12. Device according to claim 11, wherein a reservoir for fluid at low temperature is mounted in at least one of the common pipe parts.

13. Device according to claim 7 or 8, wherein the pipe forms a closed circuit, the first and second reservoirs are mounted in parallel with each other in the closed circuit, said pipe being locally split into two branches, one of said first and second reservoirs being mounted in each branch, and means are provided for closing off the two branches on both sides of the reservoir mounted therein in such a manner that when one branch is closed upstream from one reservoir, the other branch can be opened downstream from the second reservoir and vice versa.

14. Device according to claim 13 wherein, the means for closing the channels are three-way cocks.

* * * * *

UNITED STATES PATENT AND TRADEMARK OFFICE

CERTIFICATE OF CORRECTION

PATENT NO. : 5,242,272

DATED : September 7, 1993

INVENTOR(S) : Kari Ven et al.

It is certified that error appears in the above-indentified patent and that said Letters Patent is hereby corrected as shown below:

On the title page, Item [76],

The fourth and fifth inventors' city, should read: --Antwerpen--

Signed and Sealed this

Twelfth Day of April, 1994

*Attest:*

Bruce Lehman

BRUCE LEHMAN

*Attesting Officer*

*Commissioner of Patents and Trademarks*